United States Patent [19]

Lisiecki

[11] Patent Number: 4,520,930

[45] Date of Patent: Jun. 4, 1985

[54] CONTAINER AND BLANK FOR CONSTRUCTING SAME

[75] Inventor: Robert E. Lisiecki, Orchard Lake, Mich.

[73] Assignee: Ex-Cell-O Corporation, Troy, Mich.

[21] Appl. No.: 490,767

[22] Filed: May 2, 1983

[51] Int. Cl.[3] ..... B65D 5/74

[52] U.S. Cl. ..... 206/628; 206/633; 229/75; 220/258

[58] Field of Search ..... 229/75; 220/258; 206/605, 608, 609, 615, 628, 633

[56] References Cited

U.S. PATENT DOCUMENTS

| | | | |
|---|---|---|---|
| 3,770,185 | 11/1973 | Reeves | 229/75 |
| 3,807,621 | 4/1974 | Sugesawa et al. | 206/628 |
| 4,192,420 | 3/1980 | Worrell, Sr. et al. | 220/258 |
| 4,300,676 | 11/1981 | Locke et al. | 206/628 |
| 4,318,479 | 3/1982 | Lisiecki | 229/75 |
| 4,380,706 | 6/1983 | Korte | 206/628 |
| 4,420,080 | 12/1983 | Nakamura | 220/258 |

*Primary Examiner*—Joseph Man-Fu Moy
*Attorney, Agent, or Firm*—John P. Moran

[57] ABSTRACT

The drawings and description disclose a thermoplastic coated square or rectangular cross-section container suitable for being filled with milk, juice or other still beverage, and having a top closure arrangement adapted to being readily partially opened to disclose an opening therein. The opening may be suitable for a straw or, alternatively, for drinking or pouring therefrom. The top closure arrangement includes edge panels on three sides thereof, with the front edge panel including straw opening means and having a central portion thereof adaptable to being folded back onto itself around a weakened or perforated line and having a lift tab extending therefrom, and a cover panel secured to the three edge panels such that the cover panel is peeled away from the front edge panel by manually lifting the lift tab. Alternately, in one embodiment, lifting the lift tab exposes a straw opening access to the contents, without disturbing the cover panel.

15 Claims, 11 Drawing Figures

CONTAINER AND BLANK FOR CONSTRUCTING SAME

TECHNICAL FIELD

This invention relates generally to thermoplastic coated paperboard containers and, more particularly, to a blank and a container including a top end closure of an improved flat top construction and including lift tab type opening means for exposing a straw hole or other shaped opening.

BACKGROUND ART

Containers for beverages such as milk, cream, other dairy products, juices, and the like, are conventionally constructed from thermoplastic coated paperboard. Typically, these containers include a top end closure with a folded gable roof having a vertically projecting seal at the roof ridge for sealing the container and providing a readily available pouring spout when the contents of the container are to be dispensed. At times, various additional means are provided for enhancing the folding over of the gable roof into a slant top or flat top configuration, retaining the typical pouring spout feature.

Coated paperboard blanks for constructing such a container are made on converting machines similar to those disclosed by Monroe et al. U.S. Pat. No. 2,682,208 and Earp U.S. Pat. No. 3,731,600. After construction, the blanks are processed by forming, filling and sealing machines, such as those disclosed by Monroe et al. U.S. Pat. No. 3,303,761, Allen U.S. Pat. No. 3,918,236, Egleston U.S. Pat. No. 3,398,659 or Young U.S. Pat. No. 4,193,833, to produce the formed, filled and sealed containers of the type referred to above and shown and described in Egleston et al. U.S. Pat. Nos. 3,270,940 and 3,120,335.

A flat top arrangement which does not include a gable top configuration is shown and described in Lisiecki U.S. Ser. No. 352,403. The latter arrangement is adaptable to being fully opened at the top to dispense a frozen juice concentrate therethrough.

While the above types of containers have been generally satisfactory for milk and juice products, it is desirable in some instances to utilize a similar square or rectangular thermoplastic coated paperboard container for milk or juices with a flat top closure arrangement which is adaptable to being partially opened to expose an opening on the flat surface, rather than having the conventional pouring spout arrangement integrally formed thereon.

DISCLOSURE OF INVENTION

Accordingly, a general object of the invention is to provide a blank for a liquid container including improved top closure means for attaining the above mentioned desirable arrangement.

Another object of the invention is to provide an improved thermoplastic coated paperboard container suitable for being used with a straw without being opened into a conventional pouring spout.

A further object of the invention is to provide a square or rectangular paperboard container including an improved flat top closure arrangement with integral sanitary straw opening means, protected against contamination.

A still further object of the invention is to provide a flat top container having two side edge panels, a front edge panel having a selected shape opening formed therein and which is adaptable to being sealed at the ends thereof to the side edge panels, with a centrally located extention thereof being folded back across itself such that a lift tab extends beyond the front body panel, and a cover panel integrally connected to the top of the back body panel and adapted to fold across the entire top of the container and be sealed to the side and front edge panels over the opening.

Still another object of the invention is to provide such a flat top container wherein a hinged flap or segment is cut into the front edge panel in lieu of a straw opening therein.

Still another object of the invention is to provide such a flat top container wherein the lift tab may be secured to either the front body panel or to the cover panel, and, if to the latter, to provide the option of exposing a straw opening upon lifting the lift tab, or to use the lift tab to peel back portions of the top layers to expose opening means for pouring or drinking therefrom.

Other objects and advantages of the invention will become more apparent when reference is made to the following description and accompanying drawings.

BEST MODE OF CARRYING OUT THE INVENTION

Figure 1:
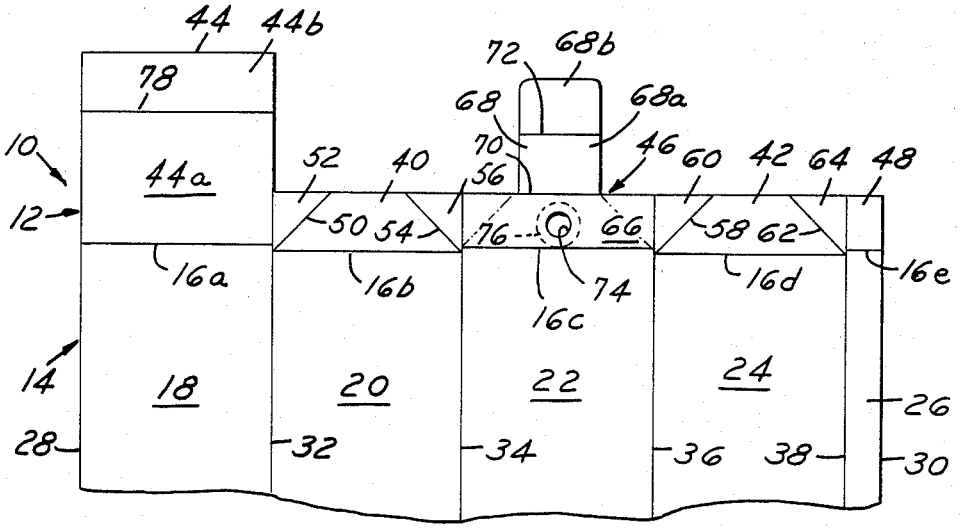
FIG. 1 is a fragmentary layout view of the outside surface of a coated paperboard container blank used to construct a container having a top end closure in accordance with the present invention.

Referring now to the drawings in greater detail, FIG. 1 illustrates a container blank 10 formed in accordance with the principles of the present invention. The container blank 10 is generally divided into three sections including a top end closure 12, a body portion 14, and a flat bottom end closure (not shown). The latter may be any suitable end closure arrangement and is not a part of this invention.

More specifically, staggered top horizontal score lines 16*a*, 16*b*, 16*c*, 16*d* and 16*e* extend transversely across the container blank 10 and separate the top end closure 12 and the body portion 14. As shown in FIG. 1, score lines 16*a*, 6*c* and 16*e* are at the highest elevation, score lines 16*b* and 16*d* are located below the score lines 16*a*, 16*c* and 16*e* a distance substantially equal to the thickness of the paperboard. A staggered bottom horizontal score line (not shown) extends transversely across the container blank 10 and separates the bottom end closure (not shown) and the body portion 14. The body portion 14 comprises a plurality of integrally connected body panels, namely, a back panel 18, a side panel 20, a front panel 22 and a side panel 24, and a side seam flap or narrow fifth panel 26 formed adjacent the panel 24. The container blank 10 is defined on its longitudinal sides by its edges 28 and 30. The body panels 18, 20, 22 and 24, and the side seam flap 26, are defined by vertical score lines 32, 34, 36 and 38. It should be apparent that the body panels may be substantially equal in width and hence, adaptable to being formed into a square cross-section container, or may be formed such that one pair of alternate body panels is wider than the other pair and, hence, adaptable to being formed into a rectangular cross-section container.

The top end closure 12 comprises side fold-in edge panels 40 and 42. The panels 40 and 42 are connected integrally to the upper ends of the body panel members 20 and 24, respectively. A cover panel 44 and a front edge panel 46 are connected integrally to the body panels 18 and 22, respectively. A further panel 48 is connected integrally to the upper end of the side seam flap 26.

A diagonal score line 50 extends from the approximate juncture of the score lines **16*b* and 32 to the free cut edge of the panel 40, forming a triangular fold-over panel segment 52. A diagonal score line 54 extends from the approximate juncture of the score lines 16*b* and 34 to the free cut edge of the panel 40, forming a triangular fold-over panel segment 56. Similarly, a diagonal score line 58 extends from the approximate juncture of the score lines 16*d* and 36 to the free cut edge of the panel 42, forming a triangular fold-over panel segment 60. A diagonal score line 62 extends from the approximate juncture of the score lines 16*d* and 38 to the free cut edge of the panel 42, forming a triangular fold-over panel segment 64. If desired the score lines 54 and 58 may both be formed on the front edge panel 46, converging upwardly thereon as shown in phantom, instead of on the side edge panels 40 and 42**.

Alternately, for improved carton top configuration, it may be desirable to move the point of intersection of the diagonal score lines 50 and 54 from the junctures of the vertical and horizontal score line **16*b* spaced apart from the respective vertical score lines 32 and 34, and the diagonal score lines 58 and 62 from the junctures of the vertical and horizontal score line 16*d* spaced apart from the respective vertical score lines 36 and 38, causing the panel segments 52, 56, 60 and 64** to be substantially trapezoidal in shape.

The front edge panel 46 includes a fold-in segment 66 connected to the body panel 22 and a narrow segment 68 extending from the panel segment 66, with a line 70 therebetween, which may be scored, perforated, or partially cut. A horizontal score line 72 is formed across the panel segment 68 at a distance from the score line 70 approximately equal to the height of the panel segment 66, separating the segment 68 into a fold-out portion **68*a* and a fold-down portion 68*b*, the latter to become a lift tab, as will be explained. An aperture or opening 74 is formed at approximately the center of the panel segment 66, and a partial cut 76 is formed around the opening 74, through the thermoplastic layer of the panel segment 66**.

The cover panel 44 includes a horizontal score line 78 formed thereacross a distance from the free cut edge thereof approximately equal to the height of the panel segment 66, and separating the panel 44 into inner portion **44*a* and outer portion 44*b***.

The container blank 10 illustrated in FIG. 1 is first formed into a side seam blank in the customary manner by rotating the body panel 24 and the side seam flap 26 as a unit about the vertical score line 36, and having the inside surfaces of the body panel 24 come into contact with the inside surface of the body panel 22, with the vertical score line 38 positioned next to the vertical score line 34, and with the inside surface of the side seam flap 26 contacting the inside surface of the body panel 20 adjacent the vertical score line 34. The body panel 18 is then rotated about the vertical score line 32 to bring its inside surface into contact with the inside surface of the body panel 20. The inside surface of the body panel 18 along the edge 28 comes into contact with the outside surface of the side seam flap 26, and the edge 28 is positioned paralle! and aligned with the vertical score line 38. The various members of the top end closure 12 and the bottom end closure will make similar movements. The container blank 10 is then sealed where the inside area of the body panel 18 comes into contact with the outside surface of the side seam flap 26.

In the FIG. 1 structure, if desired, in the formation of the side seam blank the side seam panel 26 could be sealed to the outside surface of the adjacent back panel 18, rather than to the inner surface thereof as described above.

Inasmuch as the eventual top closure arrangement of the invention is a non-gable, flat top configuration, it has been proven to be more suitable with existing forming, filling and sealing machines, to form the top closure first, in a manner heretofore used for a conventional bottom closure arrangement. Then, after filling the container through the open end, the panels associated therewith are closed and sealed.

Accordingly, after the side seam blank is opened up into a square or rectangular tubular condition, the various parts of the eventual top end closure 12 are folded on the various score lines in the following manner so as to form the top end structure. The side edge panels 40 and 42 are folded or bent inwardly toward each other on the respective score lines **16*b* and 16*d*. Such action will have caused the panel segments 40 and 42 to begin to bend along the diagonal score lines 50/54 and 58/62. The front edge panel 46 is next folded or bent inwardly, causing the panel portions 52/56 and 60/64 to be pressed downwardly into engagement with the respective panels 40 and 42, while bending along the respective diagonal score lines 50/54 and 58/62. The panel segment 68 is folded toward the panel segment 66 about the line 70. The panel segment 68*b* is folded about the scoreline 72 and adhered to the panel 22. Finally, the cover panel 44 is folded or bent inwardly and downwardly, into engagement with the panels 40 and 42, and with the panel segment 68*a***.

The sealing of the interrelated elements of the top closure 12 is then accomplished by conventional means, such as a sonic or high frequency vibration sealing means. The sealing of the various top end closure elements may also be accomplished by other means, such as gas heat, if desired. While the cover panel 44 is tightly sealed adjacent the upper ends of the body panels 20, 22 and 24 for a width equivalent to the heights of the panels 40, 42 and 66, the lift tab **68*b* may be merely spot welded or sealed to the front body panel 22** for easy release therefrom.

Figure 2:
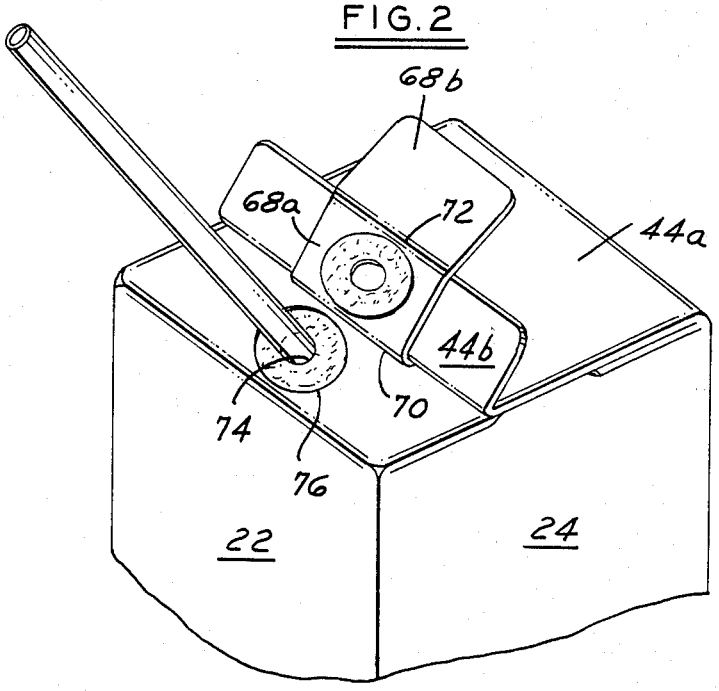
FIG. 2 is an enlarged fragmentary perspective view showing the container evolved from the blank of FIG. 1 after the top closure has been sealed closed and then opened into a usable condition.

In opening the carton, the lift tab formed by the panel portion **68*b* is lifted from the front body panel 22 and peeled back, pulling the overlapped panel portions 68*a*** and 44*b* away from the panel segment 66, bending about the juxtapositioned score lines 70 and 78, as shown in FIG. 2. This action exposes the opening 74 and removes a partial layer of material between the opening 74 and the cut 76. The removal of such partial layer assures a clean and unfragmented opening 74.

Figure 3:
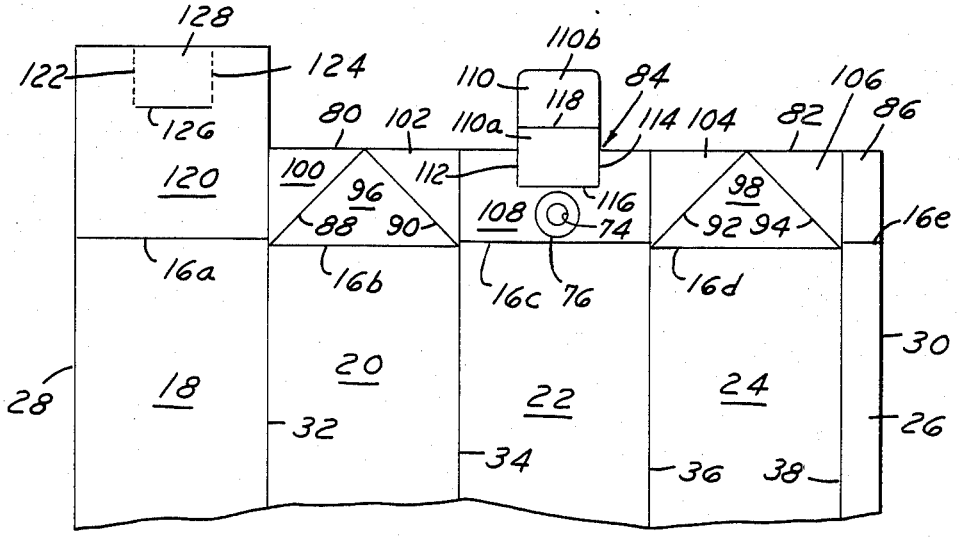
FIGS. 3, 5 and 8 are fragmentary layout views of the outside surfaces of modified forms of blanks from which containers embodying the invention may be erected.

Referring now to FIG. 3, there is illustrated an alternate blank embodiment, wherein all elements which are the same as those in the FIG. 1 embodiment bear the same reference numerals. However, top closure panels 80, 82, 84 and 86 replace the panels 40, 42, 46 and 48, respectively, of FIG. 1. The height of each of the panels 80 and 82 is approximately one-half the width of the side panels, and each includes a pair of converging diagonal score lines 88/90 and 92/94, respectively, to form conventional substantially triangular fold-in panel segments 96 and 98, with adjacent pairs of fold-out panel segments 100/102 and 104/106. The panel 84 includes a fold-in segment 108, whose free cut edge is substantially aligned with the free cut edges of the panels 80 and 82, and a narrow segment 110 extending therefrom. The latter includes a fold-out portion 110*a* and a portion 110*b*. The portion 110*a* is in part cut out of the segment 108 by spaced vertical cut lines 112 and 114, while remaining attached to the segment 84 by a score line 116. The portion 110*b* is an extension of the portion 110*a*, attached thereto by a score line 118, and adapted to serve as a lift tab.

A cover panel 120 is comparable to the panel 44 of the FIG. 1 blank, except that spaced parallel, partially cut or perforated lines 122 and 124 are formed thereon, extending inwardly from the edge opposite the score line 16*a* a distance substantially equal to the height of the panel portion 110*a*. A score line 126 is formed on the panel 120 between the inner ends of the cut lines 122 and 124, the lines 122, 124 and 126 encompassing a panel portion 128 of the panel 120.

Figure 4:
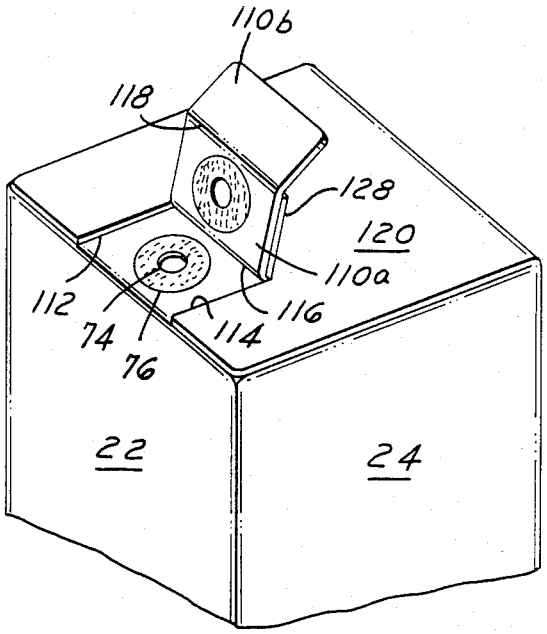
FIGS. 4, 7, 10 and 11 are fragmentary perspective views showing the containers evolved from the blanks of FIGS. 3 and 5, respectively, after the top closures have been sealed closed and then opened into a usable condition.

Folding and sealing is accomplished in substantially the same manner as described above relative to FIG. 1. When it is desired to open the container, as shown in FIG. 4, the lift tab formed by the panel portion 110*b* is lifted from the front panel 22 and peeled back, pulling the overlapped panel portions 110*a* and 128 away from the panel segment 108, bending about the juxtapositioned score lines 116 and 126. This action exposes the opening 74.

Figure 5:
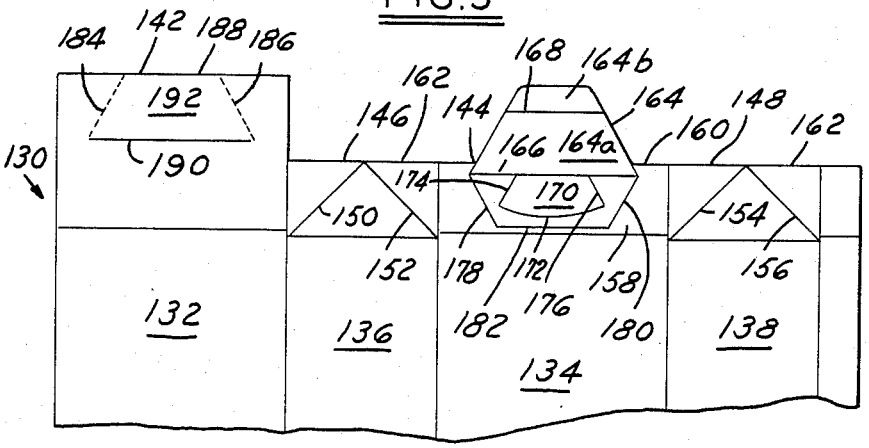
Figure 6:
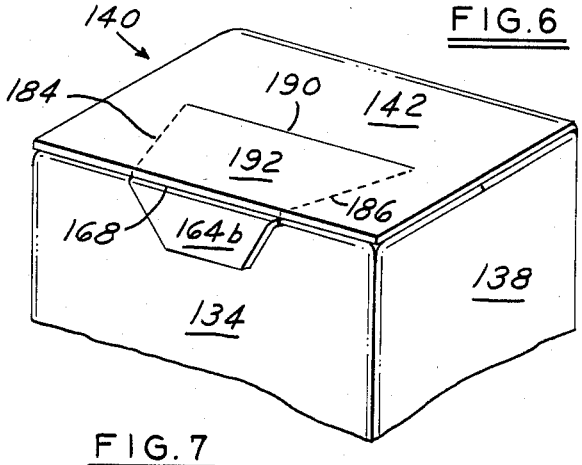
FIG. 6 is a fragmentary perspective view showing the FIG. 7 container in its closed condition.
Figure 7:
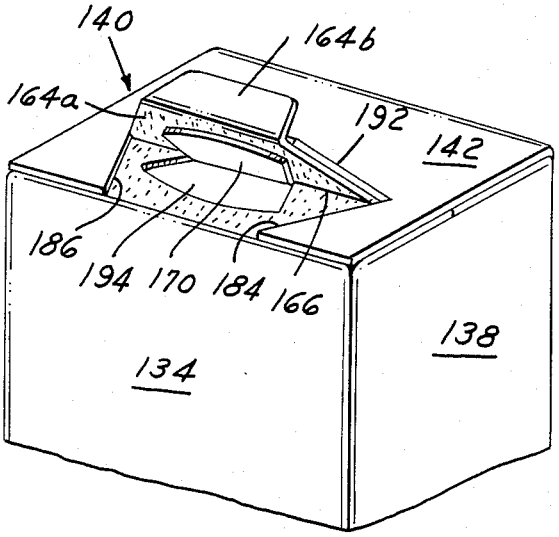

Referring now to FIG. 5, the blank 130 includes two wide sidewalls 132 and 134 and two narrow sidewalls 136 and 138, which would fold into the rectangular cross-section carton 140 shown in FIGS. 6 and 7. Top end closure panels 142, 144, 146 and 148 are extensions of the sidewalls 132, 134, 136 and 138, respectively.

The narrow closure panels 136 and 138 include respective pairs of converging diagonal score lines 150/152 and 154/156, similar to the score lines 88/90 and 92/94 of top closure panels 80 and 82 of FIG. 3.

The wide closure panel 144 includes a segment 158, whose outer edge 160 is substantially aligned with the free cut edge 162 of the panels 136 and 138, and a substantially trapezoidal-shaped extension 164 connected to the segment 158 by a score line 166 located just inside the edge 160. A horizontal score line 168 separates the extension 164 into panel portions 164*a* and 164*b*. The portion 164*b* will serve as a lift tab, as will be explained. A segment 170 is formed in the panel segment 158, adjacent the score line 166, by virtue of an arcuate cut edge 172 opposite the score line 166, and two diagonal cut edges 174 and 176 between the edge 172 and the score line 166. A pair of partial cuts 178 and 180 are formed through the thermoplastic outer layer of the blank 130, and extend diagonally across the panel segment 158 from the respective ends of the panel extension 164 to a horizontal partial cut line 182 formed on the segment 158 just outside the score line 16*c*. The diagonal directions of the cuts 178 and 180 are substantially the reciprocals of the directions of the edges of the extension 164.

The other wide closure panel 142 is formed to have a height equal to substantially the width of each of the narrow sidewalls 136 and 138. A pair of perforated lines 184 and 186 are formed on the panel 132, extending diagonally from the free cut outer edge 188 thereof, at the same angles as the edges of the extension 164, and terminate at the ends of a horizontal score line 190, to encompass a segment 192 of the panel 142. The score line 190 is located a distance from the edge 188 approximately equal to the height of the extension portion 164*a*, causing the shape of the segment 192 to substantially coincide with the shape of the portion 164*a*, for a purpose to be described.

Once the blank 130 is formed, filled and sealed, there results the container 140 as shown in FIG. 6. Specifically, the lift tab 164*b* is folded onto and tack welded or sealed to the sidewall 134, with the portion 164*a* covering the segment 170 by being folded onto the panel segment 158. The segment 192 substantially covers the portion 164*a*.

Upon lifting the tab 164*b* from the sidewall 134, as shown in FIG. 7, it is used to peel back the cover consisting of the panel portion 164*a* and the segment 192 along the perforated lines 184 and 186 and the underlying edges of the panel portion 164*a*, around the juxtapositioned score lines 166 and 190. It is expected that the segment 170 will lift with the panel portion 164*a* to which it had been sealed during the closing operation, to expose an opening 194. However, if the segment 170 does not follow the panel portion 164*a* by breaking away therefrom, it may be pushed downwardly into the container 140 by the force of a straw, for example.

The three partial cuts 178, 180 and 182 formed in the panel segment 158 around the segment 170, have been found to facilitate the lifting of the panel portion 164*a* from the adhered underlying segment 158, i.e., when the panel portion 164*a* is lifted, there is a greater tendency for the cut edges 172, 174 and 176 to be free and to thereby permit lifting the segment 170 cleanly from the panel portion 158.

Figure 8:
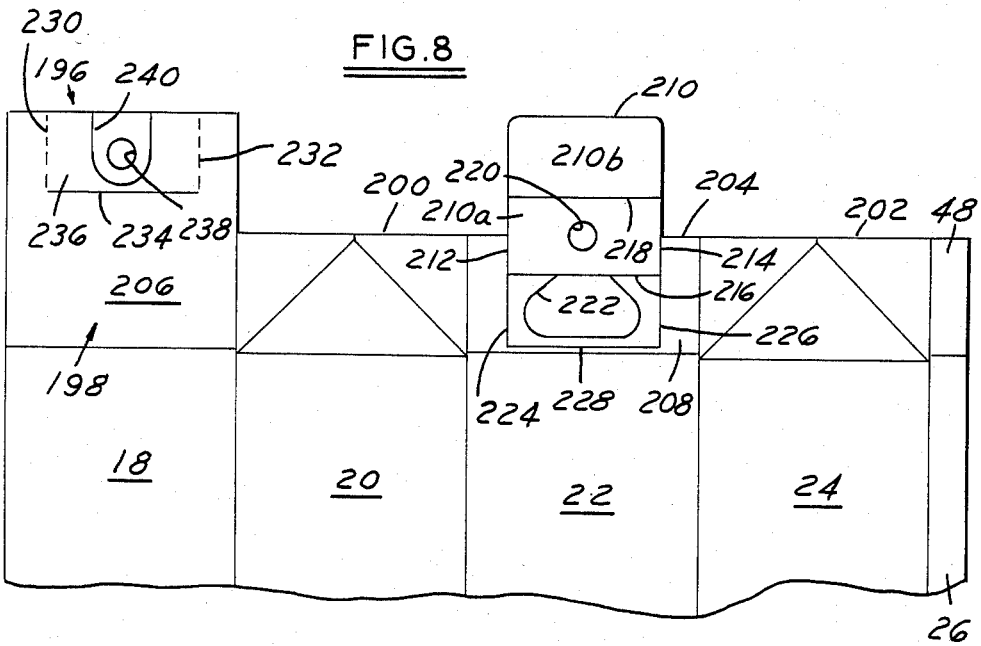

Referring now to FIG. 8, illustrating a further modification, a blank 196 includes a top end closure 198 consisting of alternate side panels 200 and 202, a front panel 204, and a cover panel 206. The front panel 204 includes a fold-in segment 208, whose free cut edge is substantially aligned with the free cut edges of the panels 200 and 202, and a narrow segment 210 extending therefrom. The latter includes a fold-out portion 210*a* and a portion 210*b*. The portion 210*a* is in part cut out of the segment 208 by spaced vertical cut lines 212 and 214, while remaining attached to the segment 204 by a score line 216. The portion 210*b* is an extension of the portion 210*a*, attached thereto by a score line 218, and adapted to serve as a lift tab, as will be explained. An aperture or opening 220 is formed at approximately the center of the fold-out portion 210*a*, and a larger shaped aperture or opening 222 is formed in the fold-in segment 208, with one edge thereof which may coincide with a middle portion of the score line 216. A pair of spaced parallel, partial cuts 224 and 226 are formed through the thermoplastic outer layer of the fold-in segment 208, extending from the respective ends of the score line 216. A like partial cut 228 interconnects the ends of the cuts 224 and 226.

The cover panel 206 is comparable to the panel 120 of FIG. 3, with spaced, parallel perforated lines 230 and 232 formed thereon, extending inwardly from the edge opposite the score line 16*a* a distance substantially equal to the height of the panel portion 210*a*. A score line 234 is formed on the panel 206 between the inner ends of the perforated lines 230 and 232, the lines 230, 232 and 234 encompassing a panel portion 236 of the panel 206. An aperture or opening 238 is formed at approximately the center of the panel portion 236. A U-shaped partial cut 240 is formed through the thermoplastic outer layer of the panel portion 236, extending from the edge thereof and around the aperture 238.

Figure 9:
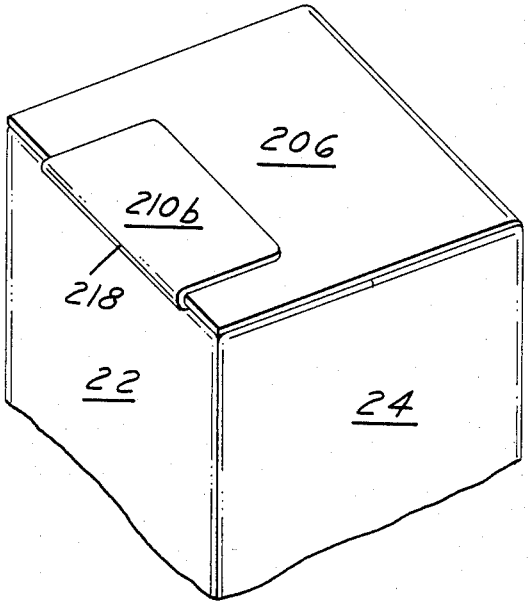
FIG. 9 is a fragmentary perspective view showing the FIG. 8 container in its closed condition.
Figure 10:
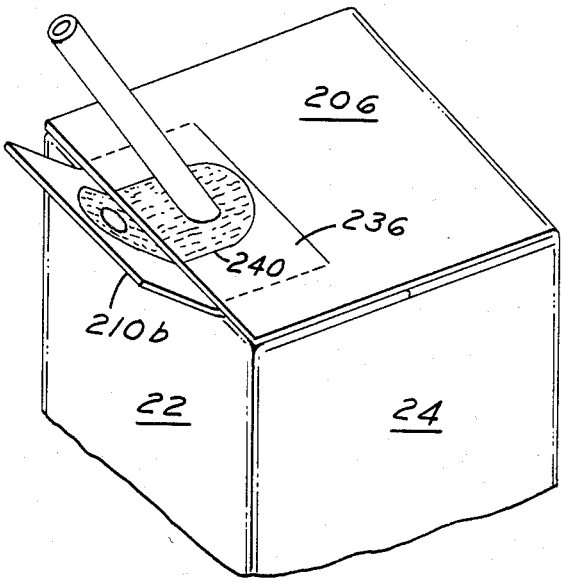
Figure 11:
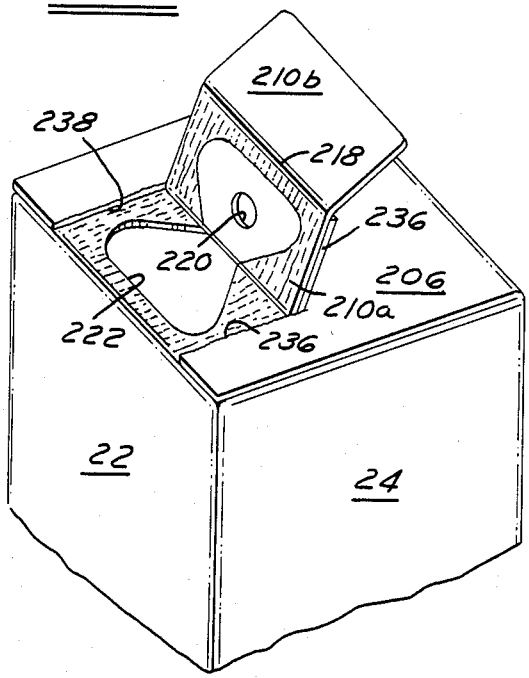

Folding and sealing is accomplished in substantially the same manner as described above, except that the lift tab portion 210*b* is folded back onto the fold-out portion 210*a* (FIG. 9), in lieu of the front side wall, and sealed thereto. When it is desired to open the container, there are to possibilities, as shown in FIGS. 10 and 11. The lift tab 210*b* is manually lifted from the portion 210*a*, bending around the score line 218, and exposing the axially aligned openings 238, 220 and 222 for the insertion of a straw therethrough. A partial layer within the U-shaped cut 240 is lifted with the lift tab portion 210*b*, assuring a clean opening 238. Alternately, once the lift tab 210*b* is lifted from the portion 210*a*, the panel portions 236 and 210*a*, as well as a partial layer within the rectangular area formed by the partial cuts 224, 226 and 228, may be lifted with it, exposing a clean shaped opening 222, suitable for pouring or drinking therefrom.

INDUSTRIAL APPLICABILITY

It should be apparent that the invention provides a novel and efficient thermoplastic coated, flat top paperboard carton which is ideally suited for being filled with milk or juice, with access thereto by lifting or peeling back a portion of the flat top structure thereof.

It should be apparent that such flat-topped carton may be adaptable to accommodating either the use of a straw, or for drinking or pouring therefrom.

It should also be apparent that the various score line and/or opening features shown in FIGS. 1, 3, 5 and 8 may be interchanged, and that each of the arrangements may be adapted such that it produces either a square or rectangular cross-section carton, as desired.

While four embodiments of the invention have been shown and described, other modifications thereof are possible.

The embodiments of the invention in which an exclusive property or privilege is claimed are defined as follows:

1. In a thermoplastic coated blank for constructing a container, the blank including body panels including front and back panels and a pair of side panels; a side fold-in edge panel integrally connected to the top end of each of said pair of side panels; a front edge panel integrally connected to the top end of said front panel and including a fold-in segment and a fold-out segment, said fold-in and fold-out segments being interconnected by a weakened line, and a score line formed across the width of said fold-out segment at a distance away from said weakened line equal to the height of said fold-in panel segment; a cover panel integrally connected to said back panel; a diagonal score line formed on each of said side fold-in edge panels at the end thereof away from said front edge panel; and an additional diagonal score line formed on one of said front fold-in panel segment or said adjacent side fold-in edge panels; the improvement comprising: said height of said front fold-in panel segment being sufficient to form an opening means therein, and an opening means formed therein.

2. The blank described in claim 1, wherein said opening means includes a substantially centrally located aperture formed therein.

3. The blank described in claim 1, wherein said opening means includes a segment of said front fold-in panel segment formed by shaped cuts through said front fold-in panel segment, with an edge thereof substantially coinciding with said score line across the width of said fold-out segment.

4. The blank described in claim 1, and a score line formed across said cover panel at a distance from the free cut edge thereof approximately equal to the height of said fold-in panel segment.

5. The blank described in claim 1, and a score line formed partially across said cover panel at a distance from the free cut edge thereof approximately equal to the height of said fold-in panel segment, and a perforated line formed in said cover panel from each end of said partial score line to said free cut edge.

6. The blank described in claim 1, and a line cut partially through said front fold-in panel segment around at least three sides of said opening means.

7. In a thermoplastic coated container including body panels including front and back panels and a pair of side panels; a side fold-in edge panel integrally connected by a first horizontal score line to the top end of each of said pair of side panels and folded on said first horizontal score line inwardly toward one another; a front edge panel integrally connected by a second horizontal score line to the top end of said front panel and including a fold-in segment, and a fold-out segment having a fold-out portion and a fold-down portion, said fold-in segment folded on said second horizontal score line; a weakened line interconnecting said fold-in and fold-out segments such that said fold-out segment is folded on said weakened line onto and secured to said fold-in segment; a score line interconnecting said fold-out and fold-down portions such that said fold-down portion is folded on said score line; a cover panel integrally connected by a third horizontal score line to said back body panel and folded on said third horizontal score line onto and secured to said side fold-in edge panels and to said fold-out panel portion; a diagonal score line formed on each of said side fold-in edge panels so as to form a corner segment on the end of each fold-in edge panel adjacent the end thereof away from said front edge panel, said corner segment being sealed to said side fold-in edge panel beneath said cover panel; an additional diagonal score line formed on one of said front fold-in panel or said respective side fold-in edge panels providing two corner segments thereon, said two corner segments being sealed to one of said front fold-in panel and said respective side fold-in edge panels beneath said cover panel; and said fold-down panel portion serving as a lift tab for manually opening said top closure; the improvement comprising: sealing said lift tab onto one of said front body panel or said cover panel, and opening means formed in said front fold-in segment directly beneath said fold-out segment.

8. The container described in claim 7, wherein said opening means includes a substantially centrally located aperture formed therein.

9. The container described in claim 7, wherein said opening means is a segment of said fold-in segment which lifts with said fold-out segment to expose said clean opening.

10. The container described in claim 7, and a score line formed at least part way across said cover panel at a distance away from the free cut edge thereof equal to the height of said fold-in panel segment for bending said portion of said cover panel thereabout.

11. The container described in claim 10, and a pair of perforated lines formed between said free cut edge and the respective ends of said score line formed on said cover panel forming an intermediate segment, and adapted to separate and permit the intermediate segment of said cover panel to be lifted with said fold-out segment upon the manual lifting of said lift tab.

12. The container described in claim 10, and a cut formed part way through said fold-in segment around at least a portion of said aperture, and adapted to permit a partial layer of the fold-in segment to be lifted with said fold-out segment upon the latter being lifted by said lift tab, to thereby exposed a clean opening of said aperture.

13. The container described in claim 11, wherein said intermediate segment of said cover panel is substantially identical in shape to said fold-out panel, and overlies and is sealed to the latter.

14. The container described in claim 12, wherein said cut formed at least part way through said fold-in segment is substantially identical in shape to said fold-out panel for being lifted with the latter.

15. The container described in claim 11, and an aperture formed in said intermediate segment axially aligned with said opening means, wherein said lift tab is sealed against said intermediate segment.

* * * * *